US006078773A

United States Patent [19]

Shimojo et al.

[11] Patent Number: 6,078,773

[45] Date of Patent: Jun. 20, 2000

[54] IMAGE FORMING APPARATUS AND INTERMEDIATE TRANSFER MEMBER

[75] Inventors: Minoru Shimojo, Kawasaki; Akira Shimada, Shizuoka-ken; Hiroyuki Osada, Numazu; Atsushi Tanaka, Susono; Tsunenori Ashibe, Yokohama, all of Japan

[73] Assignee: Canon Kabushiki Kaisha, Tokyo, Japan

[21] Appl. No.: 09/022,897

[22] Filed: Feb. 12, 1998

[30] Foreign Application Priority Data

Feb. 14, 1997 [JP] Japan ..... 9-030083

[51] Int. Cl.[7] ..... G03G 15/01

[52] U.S. Cl. ..... 399/302; 399/308

[58] Field of Search ..... 399/297, 302, 399/308; 430/126

[56] References Cited

U.S. PATENT DOCUMENTS

| | | | |
|---|---|---|---|
| 5,571,457 | 11/1996 | Vreeland et al. | 252/519 |
| 5,600,422 | 2/1997 | Fukami et al. | 399/313 |
| 5,659,854 | 8/1997 | Masuda et al. | 399/176 |
| 5,669,052 | 9/1997 | Kusaba et al. . | |
| 5,697,604 | 12/1997 | Tanaka . | |
| 5,715,510 | 2/1998 | Kusaba et al. . | |
| 5,745,831 | 4/1998 | Nakazawa et al. . | |
| 5,774,768 | 6/1998 | Hazama et al. | 399/170 |
| 5,802,442 | 9/1998 | Konno et al. | 399/308 |

FOREIGN PATENT DOCUMENTS

| | | |
|---|---|---|
| 63-301960 | 12/1988 | Japan . |
| 6-222686 | 8/1994 | Japan . |
| 8-50419 | 2/1996 | Japan . |
| 8-095372 | 4/1996 | Japan . |
| 8-146705 | 6/1996 | Japan . |
| 8-202064 | 8/1996 | Japan . |

*Primary Examiner*—Robert Beatty
*Attorney, Agent, or Firm*—Fitzpatrick, Cella, Harper & Scinto

[57] ABSTRACT

An image forming apparatus has a first image bearing member and an intermediate transfer member onto which a toner image formed on the first image bearing member is primarily transferred and through which the toner image thus transferred is secondarily transferred onto a second image bearing member. The intermediate transfer member has a surface layer on a base layer and the surface layer contains a polyurethane resin obtained by the reaction of an olefinpolyol with an isocyanate.

18 Claims, 3 Drawing Sheets

IMAGE FORMING APPARATUS AND INTERMEDIATE TRANSFER MEMBER

BACKGROUND OF THE INVENTION

1. Field of the Invention

This invention relates to an image forming apparatus employing an electrophotographic system and also relates to an intermediate transfer member used therein. More particularly, it relates to an image forming apparatus in which a toner image formed on a first image bearing member is transferred once onto an intermediate transfer member (primary transfer) and thereafter further transferred onto a second image bearing member (secondary transfer) to obtain an image, and also relates to such an intermediate transfer member.

2. Related Background Art

Compared with image forming apparatus in which images are transferred from a first image bearing member onto a second image bearing member stuck or attracted onto a transfer drum (Japanese Patent Application Laid-Open No. 63-301960, etc.), image forming apparatus making use of an intermediate transfer member have such advantages that processing or control (for example, holding by a gripper, adsorbing or providing curvature) is not necessary for a transfer material which is the second image bearing member, and hence, the second image bearing member can be selected from various kinds of materials including both thin and thick paper having a thickness from 40 $g/m^2$ to 200 $g/m^2$ such as envelopes, postcards and label paper, whether their width is wide or narrow and their length is long or short.

Because of the aforementioned advantages, color copying machines and color printers using an intermediate transfer member have already been put on the market.

However, when in practice such image forming apparatus using an intermediate transfer member are repeatedly used, creating the following problems which must be solved.

For example, since a transfer efficiency from a photosensitive member which is the first image bearing member is not sufficiently high, a large quantity of transfer residual toner (toner remaining after transfer) must be removed by cleaning, and it is essential for the photosensitive member or intermediate transfer member to be provided with a cleaning device, so that the apparatus must have a greater load and also the cleaning device is fairly complicated in its structure and expensive.

As a countermeasure for such problems, e.g., Japanese Patent Application Laid-Open No. 6-222686 discloses a technique in which an intermediate transfer member is used which has on a base layer comprised of an elastic material such as a rubber or an elastomer a surface layer comprised of at least one resin having good release properties wherein the base layer can ensure a uniform and sufficient nip at the time of primary transfer and secondary transfer and the surface layer can achieve an improvement in the transfer efficiency (in particular, secondary-transfer efficiency). In addition, Japanese Patent Application Laid-Open No. 8-50419 discloses an intermediate transfer member in which its outermost layer is made to have a resistivity higher than its lower layer in order to simultaneously improve the transfer efficiency and image quality; and, e.g., Japanese Patent Application Laid-Open No. 8-202064 discloses an intermediate transfer member in which a surface-treated layer having a certain volume resistivity is incorporated with organic resin particles.

However, if the resistivity of an intermediate transfer member is adjusted for an electrical force to hold toner securely enough so that the transferred toner does not scatter in any environment, then the transfer residual toner is hard to clean, or for reasons of molecular structure, contraction and expansion properties and smoothness are remarkably lost, and hence, cracks in the surface layer may occur because of a contact pressure exerted by the member coming into contact with the intermediate transfer member or because of a stretch tension produced when an intermediate transfer belt is used, so that blank areas caused by poor transfer may occur at areas corresponding to the cracks. A frictional force increases between the intermediate transfer member surface and the member coming into contact with the intermediate transfer member surface, so that the rotation of the intermediate transfer member may pulsate to cause color drift when respective color toner images are superimposed. These all cause faulty images. Accordingly, further improvements have been required.

SUMMARY OF THE INVENTION

An object of the present invention is to provide an image forming apparatus having an intermediate transfer member that may cause no toner scatter during transfer to provide good images, and such an intermediate transfer member.

Another object of the present invention is to provide an image forming apparatus having an intermediate transfer member that may cause no blank areas caused by poor transfer due to cracks in the surface layer, and such an intermediate transfer member.

Still another object of the present invention is to provide an image forming apparatus having an intermediate transfer member in which the frictional force between the intermediate transfer member surface and the member coming into contact with the intermediate transfer member surface is so low that color drift does not occur, and such an intermediate transfer member.

A further object of the present invention is to provide an image forming apparatus having an intermediate transfer member that can achieve a good cleaning performance, and such an intermediate transfer member.

To achieve these objects, the present invention provides an image forming apparatus comprising a first image bearing member and an intermediate transfer member onto which a toner image formed on the first image bearing member is primarily transferred and through which the toner image thus transferred is secondarily transferred onto a second image bearing member, wherein;

the intermediate transfer member has a surface layer on a base layer, and the surface layer contains a polyurethane resin obtained by the reaction of an olefin polyol with an isocyanate.

The present invention also provides an intermediate transfer member used in the above image forming apparatus.

DESCRIPTION OF THE PREFERRED EMBODIMENTS

Figure 1:
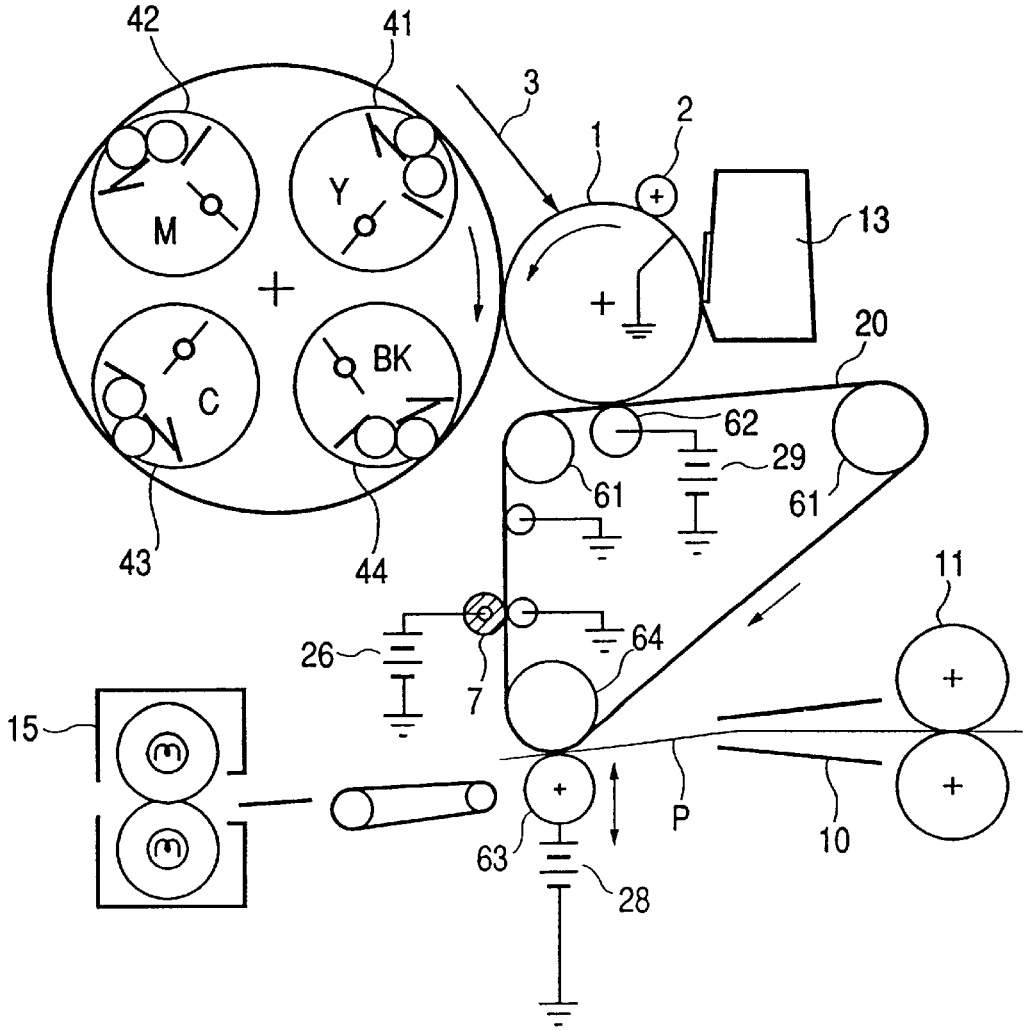
FIG. 1 schematically illustrates a full-color image forming apparatus making use of the intermediate transfer member (an intermediate transfer belt) of the present invention.

The image forming apparatus of the present invention has an intermediate transfer member onto which a toner image formed on a first image bearing member is primarily transferred and through which the toner image thus transferred is secondarily transferred onto a second image bearing member. The intermediate transfer member has a surface layer on a base layer, and the surface layer contains a polyurethane resin obtained by the reaction of an olefin polyol with an isocyanate.

According to the present invention thus constituted, the outermost layer of the intermediate transfer member gains a high potential at the initial stage and retains it for a long time so that the surface potential difference between image areas and non-image areas of the intermediate transfer member after transfer can be kept small and the toner at the image areas can be prevented from moving (or scattering) to the low-potential sites (the non-image areas) on the intermediate transfer member during the operation of the intermediate transfer member. Also, the outermost layer by no means cracks, promising a good running performance.

In the polyurethane resin used in the present invention, the component originating from the olefin polyol may preferably be in a proportion of from 10% to 60% by weight based on the total weight of the polyurethane resin. When contained within this range, a particularly good cleaning performance can be exhibited against the transfer residual toner.

If the component originating from the olefin polyol is in a proportion less than 10% by weight, any remarkable effect of preventing the toner scatter during transfer can be obtained with difficulty. If on the other hand it is in a content more than 60% by weight, the secondary transfer efficiency tends to lower to increase the transfer residual toner, so that the cleaning performance tends to deteriorate.

The olefinpolyol preferably used in the present invention includes polybutadiene polyols having hydroxyl groups at the terminals of homopolymers of butadiene or copolymers of butadiene with acrylonitrile or styrene, and polyisoprene-polyols having similar groups. The polymerization reaction for the polyurethane resin is carried out usually in the presence of a solvent, preferably using olefinpolyols in which the whole or part of the unsaturated bonds in its molecules have been hydrogenated in such a range that it is soluble in solvent. The hydrogenation thus carried out makes the surface layer tougher against deterioration caused by ozone and especially makes density unevenness hardly occur. It is preferable in the present invention that at least half the unsaturated bonds have been hydrogenated.

The polyurethane resin used in the present invention may be synthesized using at least one polyol component other than the olefinpolyol.

Such a polyol component other than the olefinpolyol may include various polyetherpolyols and polyesterpolyols which are commonly used in the production of urethane resins.

The polyetherpolyols are products obtained by addition polymerization of at least one alkylene oxide such as ethylene oxide, propylene oxide, butylene oxide or tetrahydrofuran with compounds having at least two active hydrogen. The compounds having at least two active hydrogen may include, e.g., polyhydric alcohols, amines, alkanolamines and polyhydric phenols. The polyhydric alcohols may include ethylene glycol, propylene glycol, butanediol, diethylene glycol, glycerol, hexanetriol, trimethylolpropane and pentaerythritol; amines, ethylenediamine and hexamethylenediamine; alkanolamines, ethanolamine and propanolamine; and polyhydric phenols, resorcin and bisphenols.

Exemplified as the polyester polyols are condensation polyesterpolyols such as condensation products of polyhydric alcohols with polybasic carboxylic acids or hydroxycarboxylic acids with polyhydric alcohols, lactone type polyester polyols which are polymers of lactone, and polycarbonate polyols.

The polyhydric alcohols used in these compounds may include the compounds previously exemplified in respect of the polyether polyols, and the polybasic carboxylic acids may include, e.g., adipic acid, glutaric acid, azelaic acid, fumaric acid, maleic acid, phthalic acid, terephthalic acid, dimeric acid and pyromellitic acid. Castor oil, and a reaction product of castor oil with ethylene glycol or propylene glycol are also useful as the condensation products of hydroxycarboxylic acids with polyhydric alcohols.

The polymers of lactone refer to compounds obtained by ring-opening polymerization of propionlactone, caprolactone, valerolactone, etc. in the presence of a suitable polymerization initiator.

The polycarbonate polyols refer to compounds of glycols such as 1,6-hexanediol with phosgene or ethylene carbonate.

Of these polyols, polyesterpolyols are preferred, and polycarbonatepolyols are especially preferred because low friction is easily realized.

Any of these polyols, inclusive of the olefinpolyols, may preferably have a number average molecular weight of from 100 to 10,000, and more preferably from 700 to 7,000.

The polyisocyanate compound used to produce the polyurethane resin used in the present invention can be exemplified by various compounds usually used in the production of polyurethane resins. The following are specifically named: trimethylene diisocyanate, tetramethylene diisocyanate, hexamethylene diisocyanate (HDI), dodecamethylene diisocyanate, 1,6,11-undecane triisocyanate, 2,2,4-trimethylhexane diisocyanate, lysine diisocyanate, 2,6-diisocyanate methylcarpoate, bis(2-isocyanatoethyl) fumarate, bis(2-isocyanatoethyl) carbonate, and 2-isocyanatoethyl-2,6-diisocyanate hexanoate; isophorone diisocyanate (IPDI), dicyclohexylmethane diisocyanate (hydrogenated MDI), cyclohexylene diisocyanate, methylcyclohexylene diisocyanate (hydrogenated TDI), and bis(2-isocyanatoethyl) 4-cyclohexene-1,2-dicarboxylate; xylylene diisocyanate, tetramethylxylylene diisocyanate, and diethylbenzene diisocyanate; water-modified products of HDI and trimerized products of IPDI; tolylene diisocyanate (TDI), crude TDI, diphenylmethane diisocyanate (MDI), polyphenylmethane polyisocyanate (crude MDI), modified MDI (e.g., carbodiimide-modified MDI) and naphthylene diisocyanate.

Any of these polyisocyanate compounds may be used alone or in combination.

The polyurethane resin used in the present invention may be obtained by allowing a prepolymer composition to react with a chain extender or a cross-linking agent optionally in the presence of a catalyst.

The chain-lenghening or cross-linking agent may include polyhydric alcohols such as ethylene glycol, 1,4-butanediol, trimethylolpropane, glycerol and hydroquinone diethylol ether; and/or polyvalent amines including aromatic diamines such as ethylene diamine and hexamethylene diamine, alicyclic dimamines such as isophorone diamine and 4,4'-dicyclohexylmethane diamine, aromatic dimamines such as 4,4'-diaminodiphenylmethane, aromatic aliphatic diamines such as xylene diamine, alkanol diamines such as ethanol ethylenediamine, hydrazine, and hydrazides such as adipic acid dihydrazide.

As the catalyst optionally used in the present invention, amine catalysts and organic metal catalysts may be used. Of these, as examples of the former, triethylenediamine and morpholine are preferred. As examples of the latter, dibutyltin dilaurate, tin octylate and stannous octoate are preferred. Any of these may be used in a mixture of two or more kinds.

The polymerization reaction is usually carried out in the presence of a solvent. The solvent may include ketones such as acetone, cyclohexanone, methyl ethyl ketone and methyl isobutyl ketone, esters such as ethyl acetate and butyl acetate, ethers such as tetrahydrofuran, aromatic hydrocarbons such as toluene and xylene, alcohols such as methanol, ethanol and isopropyl alcohol, polyhydric alcohol derivatives such as ethylene glycol monomethyl ether and ethylene glycol monoethyl ether, nitrogen-containing compounds such as N,N-dimethylformamide and N-methylpyrrolidone, sulfoxides such as dimethyl sulfoxide, and mixed solvents of two or more of these.

There are no particular limitations on how to produce the polyurethane resin. For example, the components may be stepwise reacted, or may be reacted at one time. Any usual production process may be used.

The reaction may also be carried out at a reaction temperature of from about 50° C. to about 120° C. and under normal pressure.

To the polyurethane resin used in the present invention, additives usually added to moisture-curable compositions may be further added so far as the remarkable advantages of the present invention can be attained; the additives being exemplified by fillers, plasticizers, colorants, curing accelerators, curing retardants, anti-sagging agents and anti-aging agents.

In order to improve lubricity of the surface of the intermediate transfer member and to improve its transfer performance, a lubricant may optionally be added in the surface layer so far as the performances attributable to the present invention are not affected. There are no particular limitations on the lubricant so long as it improves the lubricity. For example, the following may be used.

Powders of fluorine compounds including fluororubbers, fluoroelastomers, carbon fluorides comprising graphite combined with fluorine, and resins such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA); powders of silicone types such as silicone resins, silicone rubbers and silicone elastomers; powders of as silicone rubbers and silicone elastomers; powders of resins such as polyethylene (PE), polypropylene (PP), polystyrene (PS), acrylic resins, nylon resins, phenol resins and epoxy resins, and compounds or mixtures of any of these; granular carbon such as spherical graphite; and inorganic powders such as silica, alumina, titanium oxide, magnesium oxide, tin oxide and iron oxide. Any of these may be used alone or in a mixture of two or more kinds. There are no particular limitations also on the shape and diameter of particles, and particles with any shape of spheres, fibers and plates or amorphous ones may be used so long as the lubricity can be attained. With regard to particle diameter, it may preferably be within the range of, but not limited to, from 0.02 $\mu$m to 50 $\mu$m taking account of dispersibility and surface properties. These powders may be optionally surface-treated so far as the lubricity is not obstructed. A dispersant may also be used so far as no problem on various performances arises.

In the surface layer used in the present invention, at least one resin other than the polyurethane resin may be mixed so far as the remarkable advantages of the present invention can be attained.

Rubbers, elastomers or resins may be used as binders in the base layer and surface layer of the intermediate transfer member used in the present invention. As the rubbers and elastomers may be used, for example, one or two or more kinds selected from the group consisting of natural rubber, isoprene rubber, styrene-butadiene rubber, butadiene rubber, butyl rubber, ethylene-propylene rubber, ethylene-propylene copolymers, chloroprene rubber, chlorosulfonated polyethylene, chlorinated polyethylene, acrylonitrile butadiene rubber, urethane rubber, syndiotactic 1,2-polybutadiene, epichlorohydrin rubber, acrylic rubbers, silicone rubbers, fluororubbers, polysulfide rubbers, polynorbornene rubber, hydrogenated nitrile rubber, and thermoplastic elastomers (e.g., polystyrene type, polyolefin type, polyvinyl chloride type, polyurethane type, polyamide type, polyester type and fluorine resin type), but not limited to these materials.

As the resins may be used is one or two or more kinds selected from the group consisting of styrene resins (homopolymers or copolymers containing styrene or styrene derivatives) such as polystyrene, chloropolystyrene, poly-$\alpha$-methylstyrene, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer and styrene-phenyl acrylate copolymer), styrene-methacrylate copolymers (e.g., styrene-methyl methacrylate copolymer, styrene-ethyl methacrylate copolymer and styrene-phenyl methacrylate copolymer), styrene-methyl $\alpha$-chloroacrylate copolymer and styrene acrylonitrile-acrylate copolymers; methyl methacrylate resin, butyl methacrylate resin, ethyl acrylate resin, butyl acrylate resin, modified resins (e.g., silicone-modified resins, vinyl chloride resin-modified acrylic resins and acrylic-urethane resins), vinyl chloride resin, styrene-vinyl acetate copolymer, vinyl chloride-vinyl acetate copolymer, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, fluorine resins, ketone resins, ethylene-ethyl acrylate copolymer, xylene resins, polyvinyl butyral resins, polyamide resins, and modified polyphenylene oxide resins, but not limited to these materials.

A conductive agent may be added in order to adjust the resistance value of the intermediate transfer member used in the present invention. There are no particular limitations on the conductive agent, and for example, one or two or more kinds selected from the group consisting of the following may be used: carbon black, powders of metals such as aluminum and nickel, metal oxides such as titanium oxide, and conductive polymeric compounds such as quaternary ammonium salt-containing polymethyl methacrylate, polyvinyl aniline, polyvinyl pyrrole, polydiacetylene, polyethyleneimine, boron-containing polymeric compounds and polypyrrole, but not limited to these conductive agents.

Various additives can be mixed and dispersed in the binders such as the above various resins, elastomers or rubbers by appropriately using a known method. When the binder components are rubbers or elastomers, apparatus such as roll mills, kneaders and Banbury mixer may be used. When the components are liquid, ball mills, beads mills, homogenizers, paint shakers, Nanomizer or apparatus similar to these may be used to effect dispersion.

The surface layer can be provided on the base layer of the intermediate transfer member by applying a coating material, e.g., through dipping, roll coating, spray coating or brushing, or by bonding a resin film, but not limited to these.

For example, when a coating material for the surface layer of the intermediate transfer member is applied, it may preferably be applied in a coating atmosphere of from 40% RH to 60% RH in humidity. If the humidity is less than 40% RH, the coating material may dry so fast that a drying rate difference tends to be produced between the surface and the interior, resulting in a very poor surface roughness of the surface layer in some cases independent of the surface roughness of the base layer. If more than 60% RH, depending on types of solvent, the coating material may absorb moisture during coating and drying, making it impossible to form smooth coating surfaces in some cases.

The surface layer provided on the base layer in the intermediate transfer member may be a single layer, or may optionally be composed of two or more layers.

The intermediate transfer member used in the present invention may be in the shape of a roller or drum (FIG. 2; intermediate transfer belt) having on a cylindrical conductive support the base layer containing at least one of the rubber, elastomer and resin and having the surface layer on the base layer, or in the shape of a belt (FIG. 3; intermediate transfer belt) having the surface layer on the base layer. Various embodiments may be selected according to purposes and necessity.

Figure 2:
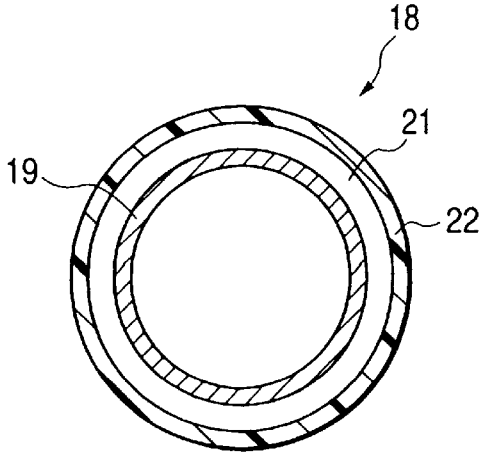
FIG. 2 schematically illustrates the layer configuration of an intermediate transfer drum of the present invention.
Figure 3:
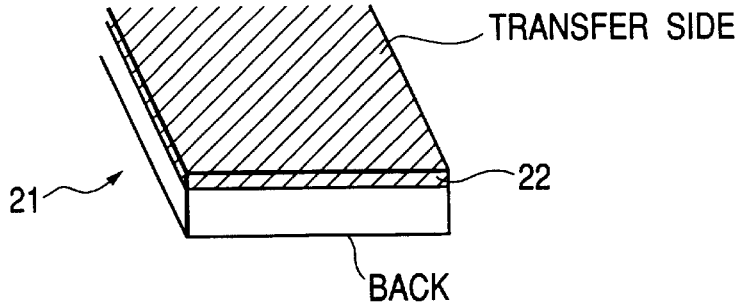
FIG. 3 schematically illustrates the layer configuration of an intermediate transfer belt of the present invention.

In FIGS. 2 and 3, reference numeral 18 denotes the intermediate transfer drum; and 20, the intermediate transfer belt. Reference numeral 19 denotes the cylindrical conductive support; 21, the base layer; and 22, the surface layer.

When the intermediate transfer member used in the present invention is the intermediate transfer drum, the cylindrical conductive support may be made of a metal or alloy such as aluminum, iron, copper or stainless steel or a conductive resin with carbon or metal particles dispersed therein. It may have the shape of the cylinder as described above, a cylinder with a shaft passed through its center, or a cylinder whose interior has been reinforced.

The intermediate transfer drum used in the present invention may be produced, e.g., in the following way. First, a metal roller as the cylindrical conductive support is prepared. The rubber, elastomer or resin is molded by melt extrusion or injection molding or formed into a layer by dip coating or spray coating to provide the base layer. Next, the materials for the surface layer are molded by melt extrusion or injection molding or formed into a layer by dip coating or spray coating to provide the surface layer.

When the intermediate transfer member used in the present invention is the intermediate transfer belt, the intermediate transfer belt may have a core material layer, whereby the mechanical strength of the intermediate transfer belt can be improved and any faulty images caused by elongation set can be perfectly prevented.

As materials constituting the core material layer may be used one or two or more kinds selected from the group consisting of natural fibers such as cotton, silk, linen and wool, chitin fiber, alginate fiber, regenerated fibers such as regenerated cellulose fiber, semisynthetic fibers such as acetate fiber, synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyalkyl paraoxybenzoate fiber, polyacetal fiber, aramid fiber, polyfluoroethylene fiber and phenol fiber, inorganic fibers such as carbon fiber, glass fiber and boron fiber, and metal fibers such as iron fiber and copper fiber, but not limited to these materials.

Figure 4:
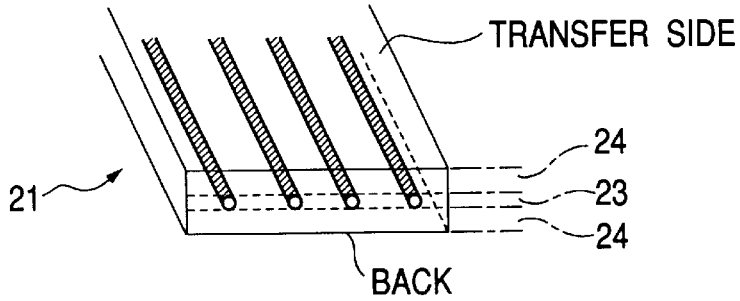
FIG. 4 schematically illustrates a base layer of the intermediate transfer belt of the present invention, having a yarn type core material layer.
Figure 5:
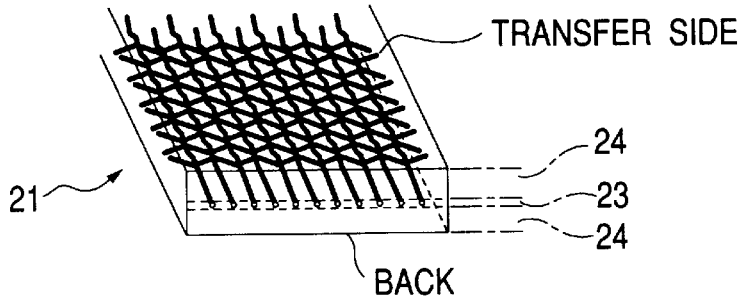
FIG. 5 schematically illustrates a base layer of the intermediate transfer belt of the present invention, having a woven fabric type core material layer.
Figure 6:
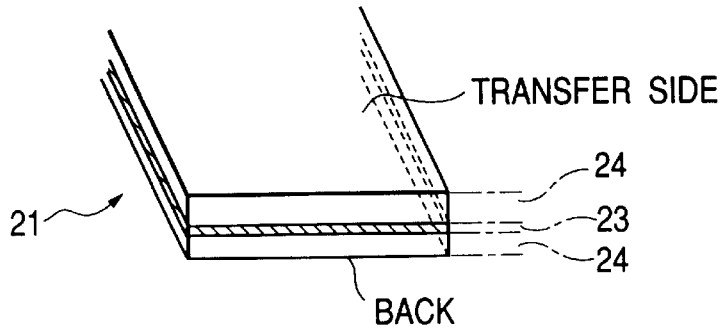
FIG. 6 schematically illustrates a base layer of the intermediate transfer belt of the present invention, having a film type core material layer.

Specific examples of the form of the core material layer include woven fabric, nonwoven fabric or film as shown by reference numeral 23 in FIGS. 4 to 6. That is, the core material layer is not necessarily a continuous layer having no gaps. From the viewpoints of ease of production and production cost, the core material layer may preferably be in the form of yarn or a woven fabric as shown in FIGS. 4 or 5, respectively. Reference numeral 24 denotes a coat layer.

The yarn may be composed of a single filament or a plurality of filaments twisted together, which latter may be any twisted yarn of single yarn, ply yarn, 2-ply yarn and so forth. It may also be union yarn blended with, e.g., any fibers made of the material shown in the above group of materials. The yarn may optionally be subjected to suitable conductive treatment.

Similarly, as for the woven fabric, any types of woven fabric may be used, as exemplified by knitted cloth, and blended fabric may of course be used. The woven fabric also may optionally be subjected to suitable conductive treatment for its use.

There are no particular limitations on how to produce the base layer having the core material layer, and the following are exemplified: a method in which a woven fabric made into a cylinder is put on a mold or the like and a cover layer is provided thereon, a method in which a woven fabric made into a cylinder is immersed in rubber or the like and a cover layer or layers is/are provided on one side or both sides of the core material layer, a method in which the yarn is wound around a mold or the like at any desired pitches and a cover layer is provided thereon, and a method in which a cover layer is provided on a mold or the like, the core material layer is provided thereon and another cover layer is further provided thereon, i.e., the core material layer is provided between cover layers. The cover layer herein used refers to the base layer material portion, except the core material layer, of the intermediate transfer belt according to the present invention. Thus, the whole constituted of the cover layer and the core material layer is regarded as the base layer.

As previously stated, the purpose for which the core material layer is provided in the intermediate transfer belt used in the image forming apparatus of the present invention is to reinforce the intermediate transfer belt. Accordingly, the core material layer may have any thickness, but preferably a thickness ranging from 10 $\mu$m to 500 $\mu$m. If the core material layer has a thickness smaller than 10 $\mu$m, the layer tends to be less effectively reinforced. If it has a thickness larger than 500 $\mu$m, the core material layer may be so excessively rigid, thus tending to make it difficult for the intermediate transfer belt to be smoothly driven.

In the case where the core material layer is woven fabric or nonwoven fabric, the thickness of the core material layer in the present invention refers to the value given when the woven fabric or nonwoven fabric that has not been made up into the intermediate transfer member is measured using a thickness measuring device TH-102 (manufactured by Tester Sangyo K.K.).

In the case where the core material layer is in the form of yarn, the thickness or diameter of yarn is regarded as the thickness of the core material layer. The thickness or diameter of yarn is the value given when the yarn that has not been made up into the intermediate transfer member is measured using the above thickness measuring device.

In the case where the core material layer is in the form of film, the value given when the thickness of film is measured using the above thickness measuring device is regarded as the thickness of the core material layer. When, however, it can not be measured using the thickness measuring device, the intermediate transfer belt is cut in its thickness direction to microscopically observe the cross section, and the value obtained is regarded as the thickness of the core material layer.

In the case where the core material layer is in a form other than any of the foregoing, the intermediate transfer belt is cut in its thickness direction to microscopically observe the cross section, and the value obtained is regarded as the thickness of the core material layer.

The intermediate transfer member may preferably have a wall or sheet thickness as small as possible in both cases of the intermediate transfer drum and the intermediate transfer belt so long as the mechanical strength and flexibility of the intermediate transfer drum are not deteriorated or so long as the intermediate transfer belt can be smoothly driven and also the mechanical strength and flexibility of the intermediate transfer belt are not deteriorated. Specifically, it may preferably have a thickness of from 0.1 mm to 8 mm.

The base layer may preferably have a thickness of from 100 $\mu$m to 7,000 $\mu$m.

The surface layer may preferably have a thickness small enough not to deteriorate the flexibility of the underlying base layer, and specifically, may preferably have a thickness of from 1 $\mu$m to 1,000 $\mu$m.

The base layer may preferably have a resistivity of from $1\times10^4$ Ω to $1\times10^9$ Ω, and the intermediate transfer member may preferably have a resistivity of from $1\times10^7$ Ω to $1\times10^{12}$ Ω.

In particular, in the present invention, the intermediate transfer member may preferably have a resistivity at least 100 times as high as the resistivity of the base layer. Such constitution allows effective prevention of toner scatter even in a high temperature and high humidity environment.

The resistivity of each of the intermediate transfer member and the base layer in the present invention is measured under the following conditions.

Figure 7:
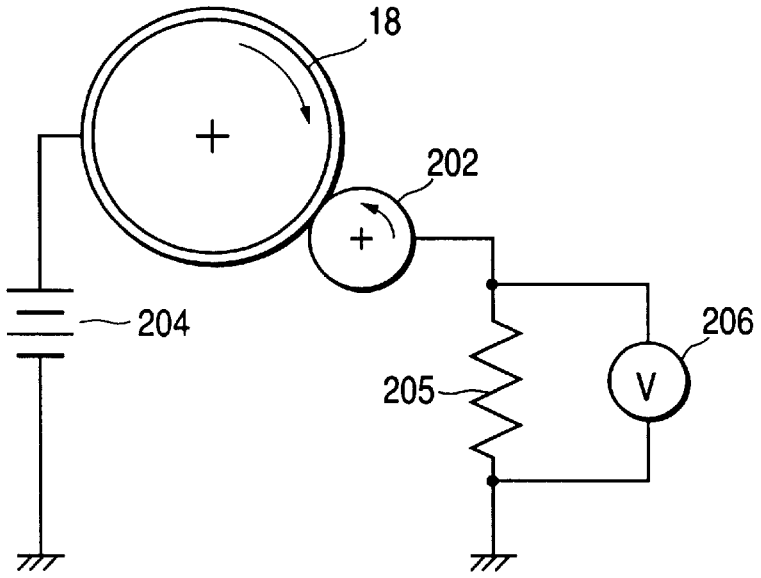
FIG. 7 schematically illustrates a device for measuring the resistance of the intermediate transfer drum of the present invention.

Measurement of resistivity of intermediate transfer member:

(1) In the case of the intermediate transfer drum, as shown in FIG. 7, the intermediate transfer drum (18) and a metal roller 202 (diameter: 30 mm to 40 mm) are brought into contact with each other at a linear pressure of 40 g/cm in such a way that the axes of the both are in parallel, and a DC power source, a resistor having a suitable resistance, and a potentiometer are connected.

(2) The metal roller is driven and the peripheral speed of the intermediate transfer drum following the metal roller is adjusted so as to be from 100 mm/second to 120 mm/second.

Figure 8:
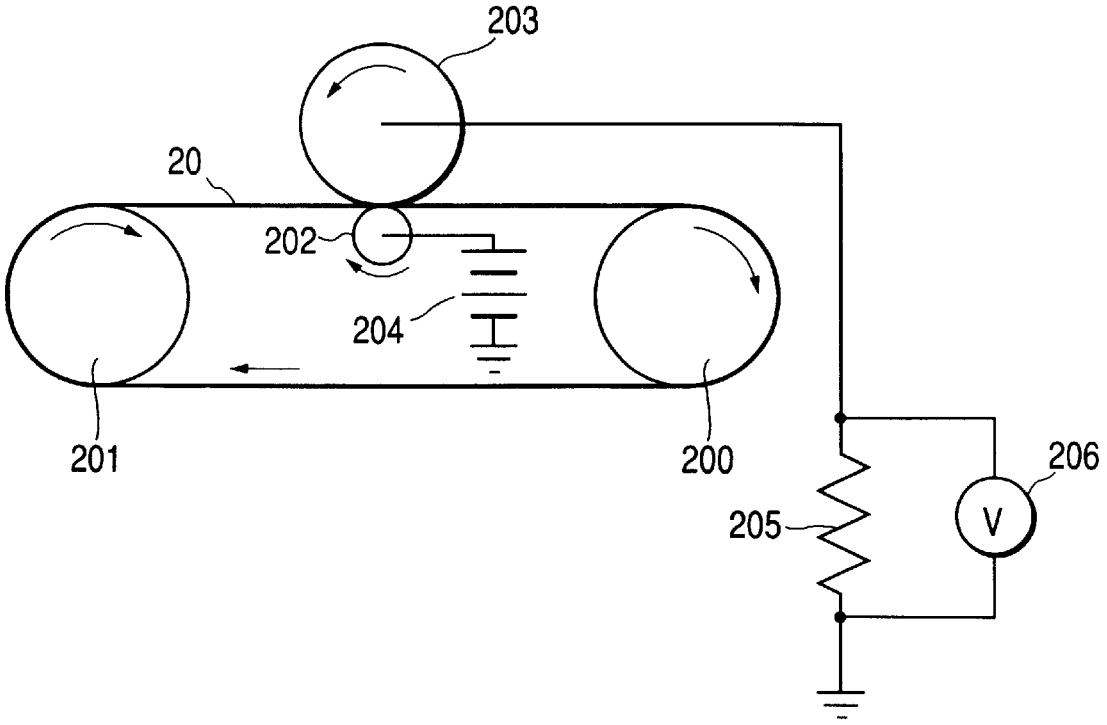
FIG. 8 schematically illustrates a device for measuring the resistance of the intermediate transfer belt of the present invention.

(3) In the case of the intermediate transfer belt, as shown in FIG. 8, the intermediate transfer belt (20) is stretched so as to be held between two metal rollers 202 and 203, and a DC power source, a resistor having a suitable resistance, and a potentiometer are connected.

(4) The intermediate transfer belt is driven by means of a drive roller and the movement speed of the surface of the intermediate transfer belt is adjusted so as to be from 100 mm/second to 120 mm/second.

(5) In either instance, a voltage (+1 kV) is applied from the DC power source to the circuit, and potential difference Vr at both ends of the resistor is read on the potentiometer. When measured, the atmosphere is controlled at a temperature of 23±5° C. and a humidity of 50±10% RH.

(6) Current value I of the current flowing through the circuit is determined from the resulting potential difference Vr.

(7) Resistivity of intermediate transfer member=applied voltage (+1 kV)/current value I In FIGS. 7 and 8, reference numeral 200 denotes the drive roller; 201, a metal roller; 204, the power source; 205, the resistor; and 206, the potentiometer.

The resistivity of the base layer is measured in the same way as the above but using an intermediate transfer member having not been provided with the surface layer or an intermediate transfer member from which the surface layer has been stripped with a suitable solvent. DC voltage is applied at +100 V.

A color image forming apparatus according to the present invention which utilizes an electrophotographic process is shown in FIG. 1 as a schematic illustration of its constitution.

Reference numeral 1 denotes a drum-shaped electrophotographic photosensitive member (hereinafter "photosensitive drum") serving as the first image bearing member, and is rotated in the direction of an arrow at the preset peripheral speed (process speed).

The photosensitive drum 1 is, in the course of its rotation, uniformly electrostatically charged to the predetermined polarity and potential by means of a primary charging assembly 2, and then subjected to exposure to light 3 emitted from an imagewise exposuring means 3 (not shown; an exposure optical system for the color separation/image formation of color original images, or a scanning exposure system employing a laser scanner that outputs laser beams modulated in accordance with time-sequential electrical digital pixel signals of image information). Thus, an electrostatic latent image is formed which corresponds to a first color component image (e.g., yellow color component image) of the intended color image.

Next, the electrostatic latent image is developed with first-color yellow toner Y by means of a first developing assembly (yellow developing assembly 41). In that course, second to fourth developing assemblies (magenta color developing assembly 42, cyan color developing assembly 43 and black color developing assembly 44) are not actuated and do not act on the photosensitive drum 1. Hence, first-color yellow toner images are not affected by the second to fourth developing assemblies.

An intermediate transfer member 20 is rotatively driven in the direction of an arrow at the preset peripheral speed.

In the course of passing through the nip between the photosensitive drum 1 and the intermediate transfer member 20, the first-color yellow toner images formed and held on the photosensitive drum 1 are intermediately transferred successively to the periphery of the intermediate transfer member 20 (primary transfer) by the aid of an electric field formed by primary transfer bias applied to the intermediate transfer member 20 from a primary transfer roller 62.

The surface of the photosensitive drum 1 on which the transfer of the first-color yellow toner images has been completed is cleaned by a cleaning assembly 13.

Subsequently, second-color magenta toner images, third-color cyan toner images and fourth-color black toner images are successively superimposed and transferred onto the intermediate transfer member 20, thus the intended full-color toner image is formed.

Reference numeral 63 denotes a secondary transfer roller, which is so provided that it is axially supported in parallel to a secondary transfer counter roller 64 and is separable at a distance from the bottom surface of the intermediate transfer member 20.

The primary transfer bias for successively superimposing and transferring the first- to fourth-color toner images from the photosensitive drum 1 to the intermediate transfer member 20 has a polarity reverse to that of the toners, and is applied from a bias power source 29. Its applied voltage is in the range of, e.g., from +100 V to +2 kV.

In the course of the primary transfer, the secondary transfer roller 63 and a charging assembly 7 for cleaning are kept apart from the intermediate transfer member 20.

The full-color toner image formed on the intermediate transfer member 20 is transferred to the second image bearing member, transfer medium P, in the following way: The secondary transfer roller 63 is brought into contact with the intermediate transfer member 20 and also the transfer medium P is fed through a paper feed roller 11 to the contact nip between the intermediate transfer member 20 and the secondary transfer roller 63 at given timing, where the secondary transfer bias is applied to the secondary transfer 63 from the bias power source 28. The transfer medium P on which the full-color toner image has been transferred is introduced into a fixing assembly 15, and is heated and fixed there.

After the transfer of the toner image to the transfer medium P has been completed, the charging assembly 7 for cleaning is brought into contact with the intermediate transfer member 20 to apply a bias with a polarity reverse to that of the photosensitive drum 1, so that charges with a polarity reverse to that of the photosensitive drum 1 is imparted to the toner not transferred to the transfer medium P and remaining on the intermediate transfer member 20 (the transfer residual toner).

The transfer residual toner is electrostatically transferred to the photosensitive drum 1 at the nip between the photosensitive drum 1 and the intermediate transfer member 20 and in the vicinity thereof, so that the intermediate transfer member is cleaned.

EXAMPLES

The present invention will be described below in greater detail by giving Examples.

Example 1

A rubber compound formulated as shown below, previously extruded in the shape of a tube, was mounted on a cylindrical mold, and polyester yarn (diameter: 100 $\mu$m) surface-coated with an adhesive was wound around it in a spiral at a pitch of 0.7 mm. A rubber compound formulated as shown below, previously extruded in the shape of a tube, was further covered thereon, followed by vulcanization and polishing, obtaining a rubber belt (the base layer) interlayed with a core material layer of 0.73 mm thick. The rubber belt thus obtained had a resistivity of $1.8\times10^6$ Ω.

| Rubber composition: | (by weight) |
|---|---|
| NBR rubber | 75 parts |
| EPD rubber | 25 parts |
| Vulcanizing agent | 4 parts |
| Vulcanizing auxiliary | 2 parts |
| Vulcanizing accelerator | 3 parts |
| Conductive agent (carbon black) | 20 parts |
| Dispersing agent | 1 part |
| Plasticizer (paraffin type process oil) | 5 parts |

Next, a coating material used to form a surface layer on the rubber belt (the base layer) was prepared in the following formulation.

Coating material composition:

| | |
|---|---|
| Polyurethane resin solution (solid content: 20% by weight) | 100 parts |

Polyols: Polyolefinpolyol (at least 80%-hydrogenated polybutadienediol; number average molecular weight: 3,000) and polycarbonatepolyol (hexamethylene carbonatediol)

Polyisocyanate: Isophorone diisocyanate (IPDI)

Chain-lengthening agent: Isophorone diamine (IPDA)

Solvent: Toluene/isopropyl alcohol (IPA)=6/4 (weight ratio)

Polytetrafluoroethylene (PTFE) resin particles

| | |
|---|---|
| Polytetrafluoroethylene (PTFE) resin particles | 16 parts |
| Dispersing agent | 0.8 part |
| Methyl ethyl ketone | 180 parts |
| N-methylpyrrolidone | 60 parts |

The base layer was spray-coated with the above coating material, and the coating formed was dried to the touch, followed by heating at 140° C. for 1 hour to remove the remaining solvent. Thus, an intermediate transfer belt having a surface layer of 20 $\mu$m thick was obtained. In the polyurethane resin, the component originating from the olefinpolyol was in a proportion of 43% by weight. The intermediate transfer belt thus obtained had a resistivity of $5.2\times10^9$ Ω.

This intermediate transfer belt was set in the full-color electrophotographic apparatus shown in FIG. 1, and full-color images were printed on 5,000 sheets of 80 g/m$^2$ paper in an environment (N/N) of temperature 23° C./humidity 60% RH and in an environment (H/H) of temperature 30° C./humidity 80% RH. The images formed were visually evaluated. Color drift was observed using a 30× magnifier. Results obtained are shown in Table 1.

In the present Example, images were formed under the following main conditions.

Color developers (four colors in common):

Non-magnetic one-component developer (toner)

Primary transfer voltage: +500 V

Secondary transfer electric current: +10 $\mu$A

Process speed: 110 mm/sec.

Images were evaluated according to the following criteria:

(Toner scatter during transfer)

AA: Toner scatter is not seen at all.

A: Toner scatter is very slightly recognizable on images as spots around line images, but no problem in practical use.

B: Toner scatter is recognizable on images as spots around line images.

C: Toner scatter is notably recognizable on images as spots around line images.

(Blank areas caused by poor transfer)

AA: No cracking occur in the outermost layer of the intermediate transfer member, and no blank area caused by poor transfer is seen on images at all.

A: Cracking slightly occur in the outermost layer of the intermediate transfer member, and blank areas caused by poor transfer are slightly seen on images in part, but no problem in practical use.

B: Cracking slightly occur in the outermost layer of the intermediate transfer member over the whole area, and blank areas caused by poor transfer are slightly seen on images over the whole area.

C: Cracking occur in the outermost layer of the intermediate transfer member over the whole area, and blank areas caused by poor transfer are seriously seen on images over the whole area.

(Color drift)

AA: Not seen at all.

A: Slightly recognizable on images in part, but no problem in practical use.

B: A little recognizable on images.

C: Notably recognizable on images.

(Cleaning performance)

AA: Stained images due to faulty cleaning are not seen at all.

A: Stained images are slightly seen in part, but no problem in practical use.

B: Stained images are seen over the whole area.

C: Stained images are seriously seen over the whole area.

(Halftone uneven density)

AA: Not seen at all.

A: Slightly seen on images in part, but no problem in practical use.

B: Seen on images over the whole area.

C: Seriously seen on images over the whole area.

Example 2

Using a mold, a rubber compound formulated as shown below was transfer-molded on the surface of a cylindrical roller made of aluminum, having a diameter of 182 mm, a length of 320 mm and a thickness of 3 mm. Thus, a roller (A) having a base layer of 5 mm thick was obtained. The base layer thus obtained had a resistivity of $1.3\times10^6$ Ω.

| Rubber composition: | (by weight) |
|---|---|
| NBR rubber | 35 parts |
| Epichlorohydrin rubber | 65 parts |
| Vulcanizing agent | 2 parts |
| Vulcanizing auxiliary | 2 parts |
| Vulcanizing accelerator | 3 parts |
| Conductive agent (carbon black) | 10 parts |
| Dispersing agent | 1 part |
| Plasticizer (paraffin type process oil) | 3 parts |

Next, using a coating material formulated to have the same composition as that in Example 1, the roller (A) was spray-coated with the coating material, and the coating formed was dried to the touch, followed by heating at 130° C. for 1 hour to remove the remaining solvent. Thus, an intermediate transfer drum having a surface layer of 15 μm thick was obtained. The intermediate transfer drum thus obtained had a resistivity of $3.6\times10^9$ Ω.

Full-color images were printed on 5,000 sheets in the same manner as in Example 1 except that the electrophotographic apparatus was replaced with one for the intermediate transfer drum. Evaluation was also made similarly. Results obtained are shown in Table 1.

Example 3

A base layer rubber belt interlayed with a core material layer was obtained in the same manner as in Example 1.

Next, using a coating material formulated to have entirely the same composition as that in Example 1 except that the polyurethane resin of the coating material used therein was changed to have the following composition, an intermediate transfer belt was obtained in the same manner as in Example 1. In the polyurethane resin, the component originating from the olefinpolyol was in a proportion of 35% by weight. The intermediate transfer belt thus obtained had a resistivity of $2.3\times10^9$ Ω.

| | |
|---|---|
| Polyurethane resin solution (solid content: 20% by weight) | 100 parts |

Polyols: Polyolefinpolyol (polybutadiene diol; number average molecular weight: 2,000) and polycarbonatepolyol (hexamethylene carbonatodiol)

Polyisocyanate: IPDI

Chain-lengthening agent: IPDA

Solvent: Toluene/IPA=6/4 (weight ratio)

Full-color images were printed on 5,000 sheets in the same manner as in Example 1. Evaluation was also made similarly. Results obtained are shown in Table 1.

Example 4

A base layer rubber belt interlayed with a core material layer was obtained in the same manner as in Example 1.

Next, using a coating material formulated to have entirely the same composition as that in Example 1 except that the polyurethane resin of the coating material used therein was changed to have the following composition, an intermediate transfer belt was obtained in the same manner as in Example 1.

In the polyurethane resin, the component originating from the olefinpolyol was in a proportion of 50% by weight. The intermediate transfer belt thus obtained had a resistivity of $1.8\times10^9$ Ω.

| | |
|---|---|
| Polyurethane resin solution (solid content: 20% by weight) | 100 parts |

Polyol: Polyolefinpolyol (polybutadienediol; number average molecular weight: 2,000)

Polyisocyanate: IPDI

Chain-lengthening agent: Ethylene glycol

Solvent: Toluene/N,N-dimethylformamide (DMF)=1/1 (weight ratio)

Full-color images were printed on 5,000 sheets in the same manner as in Example 1. Evaluation was also made similarly. Results obtained are shown in Table 1.

Example 5

A base layer rubber belt interlayed with a core material layer was obtained in the same manner as in Example 1.

Next, using a coating material formulated to have entirely the same composition as that in Example 1 except that the polyurethane resin of the coating material used therein was changed to have the following composition, an intermediate transfer belt was obtained in the same manner as in Example 1. In the polyurethane resin, the component originating from the olefinpolyol was in a proportion of 65% by weight. The intermediate transfer belt thus obtained had a resistivity of $7.3\times10^9$ Ω.

| | |
|---|---|
| Polyurethane resin solution (solid content: 20% by weight) | 100 parts |

Polyols: Polyolefinpolyol (polybutadienediol; number average molecular weight: 2,000) and polycarbonate polyol (hexamethylene carbonatodiol)

Polyisocyanate: IPDI

Chain-lengthening agent: IPDA

Solvent: Toluene/IPA=6/4 (weight ratio)

Full-color images were printed on 5,000 sheets in the same manner as in Example 1. Evaluation was also made similarly. Results obtained are shown in Table 1.

Example 6

A base layer rubber belt interlayed with a core material layer was obtained in the same manner as in Example 1.

Next, using a coating material formulated to have entirely the same composition as that in Example 1 except that the polyurethane resin of the coating material used therein was changed to have the following composition, an intermediate transfer belt was obtained in the same manner as in Example 1. In the polyurethane resin, the component originating from the olefinpolyol was in a proportion of 70% by weight. The intermediate transfer belt thus obtained had a resistivity of $2.6\times10^9$ Ω.

| | |
|---|---|
| Polyurethane resin solution (solid content: 20% by weight) | 100 parts |

Polyol: Polyolefinpolyol (polybutadienediol; number average molecular weight: 2,000)

Polyisocyanate: IPDI

Chain-lengthening agent: Ethylene glycol

Solvent: Toluene/DMF=1/1 (weight ratio)

Full-color images were printed on 5,000 sheets in the same manner as in Example 1. Evaluation was also made similarly. Results obtained are shown in Table 1.

Comparative Example 1

A base layer rubber belt interlayed with a core material layer was obtained in the same manner as in Example 1.

Next, using a coating material formulated to have entirely the same composition as that in Example 1 except that the polyurethane resin of the coating material used therein was changed to have the following composition, an intermediate transfer belt was obtained in the same manner as in Example 1. The intermediate transfer belt thus obtained had a resistivity of $8.8\times10^7$ Ω.

| | |
|---|---|
| Polyurethane resin solution (solid content: 20% by weight) | 100 parts |

Polyol: PBA (polyethylene adipate; number average molecular weight: 1,000)

Polyisocyanate: MDI

Chain extender: 4,4'-diaminodiphenylmethane (MDA)

Solvent: DMF/methyl ethyl ketone (MEK)=1/1 (weight ratio)

Full-color images were printed on 5,000 sheets in the same manner as in Example 1. Evaluation was also made similarly. Results obtained are shown in Table 1.

Comparative Example 2

A base layer rubber belt interlayed with a core material layer was obtained in the same manner as in Example 1.

Next, using a coating material formulated to have entirely the same composition as that in Example 1 except that the polyurethane resin of the coating material used therein was replaced with a fluororesin (fluoroolefin-vinyl ether alternating copolymer) solution (solid content: 20% by weight; solvent: xylene), an intermediate transfer belt was obtained in the same manner as in Example 1. The intermediate transfer belt thus obtained had a resistivity of $1.1\times10^{10}$ Ω.

Full-color images were printed on 5,000 sheets in the same manner as in Example 1. Evaluation was also made similarly. Results obtained are shown in Table 1.

TABLE 1

| | Toner scatter during transfer | | Blank areas caused by poor transfer | | Color drift | | Cleaning perfor-mance | | Half-tone uneven density | |
|---|---|---|---|---|---|---|---|---|---|---|
| | N/N | H/H | N/N | H/H | N/N | H/H | N/N | H/H | N/N | H/H |
| Example: | | | | | | | | | | |
| 1 | AA | A | AA | AA | AA | AA | AA | AA | AA | AA |
| 2 | AA | A | AA | AA | AA | AA | AA | AA | AA | AA |
| 3 | AA | A | AA | AA | A | A | AA | AA | AA | A |
| 4 | AA | A | AA | AA | AA | AA | AA | AA | AA | A |
| 5 | AA | A | AA | AA | AA | AA | A | A | AA | A |
| 6 | AA | A | AA | AA | A | A | A | A | AA | A |

TABLE 1-continued

| | Toner scatter during transfer | | Blank areas caused by poor transfer | | Color drift | | Cleaning perfor-mance | | Half-tone uneven density | |
|---|---|---|---|---|---|---|---|---|---|---|
| | N/N | H/H | N/N | H/H | N/N | H/H | N/N | H/H | N/N | H/H |
| Comparative Example: | | | | | | | | | | |
| 1 | C | C | B | B | B | B | A | A | A | B |
| 2 | AA | A | C | C | B | B | C | C | AA | A |

What is claimed is:

1. An image forming apparatus comprising a first image bearing member and an intermediate transfer member onto which a toner image formed on the first image bearing member is primarily transferred and through which the toner image thus transferred is secondarily transferred onto a second image bearing member, wherein;

said intermediate transfer member has a surface layer on a base layer, and the surface layer contains a polyurethane resin obtained by reaction of an olefinpolyol with an isocyanate.

2. The image forming apparatus according to claim 1, wherein components originating from said olefinpolyol in said polyurethane resin is in a proportion of from 10% by weight to 60% by weight based on the total weight of the polyurethane resin.

3. The image forming apparatus according to claim 1, wherein the unsaturated bonds of said olefinpolyol have been hydrogenated.

4. The image forming apparatus according to claim 3, wherein at least half the unsaturated bonds of said olefin polyol have been hydrogenated.

5. The image forming apparatus according to claim 1, wherein said polyurethane resin is obtained by reaction of an olefinpolyol and a polyesterpolyol with an isocyanate.

6. The image forming apparatus according to claim 5, wherein said polyesterpolyol is a polycarbonatepolyol.

7. The image forming apparatus according to claim 1, wherein said intermediate transfer member has a resistivity of from $1\times10^{7}$ Ω to $1\times10^{12}$ Ω.

8. The image forming apparatus according to claim 1, wherein said base layer has a resistivity of from $1\times10^{4}$ Ω to $1\times10^{9}$ Ω.

9. The image forming apparatus according to claim 1 or 8, wherein said intermediate transfer member has a resistivity at least 100 times as high as the resistivity of said base layer.

10. An intermediate transfer member onto which a toner image formed on a first image bearing member is primarily transferred and through which the toner image thus transferred is secondarily transferred onto a second image bearing member;

said intermediate transfer member comprising a surface layer provided on a base layer; said surface layer containing a polyurethane resin obtained by reaction of an olefinpolyol with an isocyanate.

11. The intermediate transfer member according to claim 10, wherein components originating from said olefinpolyol in said polyurethane resin is in a proportion of from 10% by weight to 60% by weight based on the total weight of the polyurethane resin.

12. The intermediate transfer member according to claim 10, wherein the unsaturated bonds of said olefinpolyol have been hydrogenated.

13. The intermediate transfer member according to claim 12, wherein at least half the unsaturated bonds of said olefin polyol have been hydrogenated.

14. The intermediate transfer member according to claim 10, wherein said polyurethane resin is obtained by reaction of an olefinpolyol and a polyesterpolyol with an isocyanate.

15. The intermediate transfer member according to claim 14, wherein said polyesterpolyol is a polycarbonatepolyol.

16. The intermediate transfer member according to claim 10, which has a resistivity of from $1\times10^{7}$ Ω to $1\times10^{12}$ Ω.

17. The intermediate transfer member according to claim 10, wherein said base layer has a resistivity of from $1\times10^{4}$ Ω to $1\times10^{9}$ Ω.

18. The intermediate transfer member according to claim 10 or 17, which has a resistivity at least 100 times as high as the resistivity of said base layer.

* * * * *

UNITED STATES PATENT AND TRADEMARK OFFICE

CERTIFICATE OF CORRECTION

PATENT NO. : 6,078,773

DATED : June 20, 2000

INVENTOR(S): MINORU SHIMOJO, ET AL.

It is certified that error appears in the above-identified patent and that said Letters Patent is hereby corrected as shown below:

COLUMN 3:
Line 20, "olefin polyol" should read --olefinpolyol--; and
Line 34, "olefin polyol" should read --olefinpolyol--.

COLUMN 9:
Line 15, "can not" should read --cannot--.

COLUMN 17:
Line 35, "olefin" should read --olefinpolyol--; and
Line 36, "polyol" should be deleted.

Signed and Sealed this

Tenth Day of April, 2001

*Attest:*

Nicholas P. Godici

NICHOLAS P. GODICI

*Attesting Officer*

*Acting Director of the United States Patent and Trademark Office*